US007172033B2

(12) United States Patent
Woodcock et al.

(10) Patent No.: US 7,172,033 B2
(45) Date of Patent: Feb. 6, 2007

(54) CULVERT OPENING AND CLEANING APPARATUS

(75) Inventors: James W. Woodcock, Sullivan, MO (US); Frank W. Woodcock, Jr., Sullivan, MO (US)

(73) Assignee: Woodybilt Manufacturing LLC, Sullivan, MO (US)

( * ) Notice: Subject to any disclaimer, the term of this patent is extended or adjusted under 35 U.S.C. 154(b) by 0 days.

(21) Appl. No.: 10/707,904

(22) Filed: Jan. 22, 2004

(65) Prior Publication Data

US 2005/0160634 A1 Jul. 28, 2005

(51) Int. Cl.
*A01B 63/00* (2006.01)

(52) U.S. Cl. ..... 172/253; 37/403; 37/364; 37/903

(58) Field of Classification Search ..... 37/364, 37/105, 403, 404, 405, 903, 264, 266; 172/817, 172/253, 254
See application file for complete search history.

(56) References Cited

U.S. PATENT DOCUMENTS 2,798,315 A * 7/1957 Gifford ..... 172/305
3,044,196 A * 7/1962 Kinney ..... 172/459
3,698,487 A * 10/1972 Ruth et al. ..... 172/305
3,706,145 A * 12/1972 Bucksch et al. ..... 37/105
4,196,532 A * 4/1980 Muller ..... 37/105
5,701,693 A 12/1997 Brocious et al.
5,953,839 A * 9/1999 Meeks ..... 37/404
6,000,152 A 12/1999 Tate
6,085,447 A 7/2000 Rose
6,305,106 B1 10/2001 McLellan
6,315,056 B1 11/2001 Ransom et al.
6,499,173 B2 12/2002 Van Ornum
6,546,650 B1 4/2003 Meurer
6,578,297 B1 6/2003 Forsberg

* cited by examiner

*Primary Examiner*—Victor Batson
(74) *Attorney, Agent, or Firm*—Blackwell Sanders Peper Martin LLP; Mark E. Stallion

(57) ABSTRACT

A culvert opening and cleaning apparatus which is designed to be operably mounted to an implement of heavy machinery such as a grader and is further designed to utilize the auxiliary hydraulic connection provided by the implement of heavy machinery. The culvert opening and cleaning apparatus comprises a mounting means operably engaged to an implement of heavy machinery, a telescoping arm member attached to the mounting means, the telescoping arm member having an outer housing and an inner concentric arm that are telescopically slidable relative to each other, a culvert cleaning tool engaged to the inner arm of the telescoping arm member, and a telescoping ram having at least one concentric cylinder and a piston that are telescopically slidable relative to each other, wherein a distal end of the piston is attached to the culvert cleaning tool for positing the culvert cleaning tool inserted in an opening of the culvert.

8 Claims, 4 Drawing Sheets

CULVERT OPENING AND CLEANING APPARATUS

BACKGROUND OF INVENTION

Field of the Invention

The present invention relates, generally, to a culvert opening and cleaning apparatus operable to open damaged and clean clogged culverts. The apparatus is designed to be operably mounted to an implement of heavy machinery such as a grader and is further designed to utilize the auxiliary hydraulic connection provided by the implement of heavy machinery.

It is relatively common in small rural areas for the roads to be made of gravel. It is also common for a drainage ditch to run along side the road. Culverts are typically spaced along the ditch to channel drainage out of the ditch to prevent the ditch from overflowing and possibly washing the road away. Over time, it is common for the culverts to become clogged at the opening with debris. It is also common that the culverts with get bent inward reducing the opening over time thereby increasing the clogging problem.

Unclogging culverts to prevent overflow and washing the road away is a time consuming and labor intensive job. Road crews will sometimes make special trips for culvert maintenance where the opening of the culverts are bent back to their original shape and unclogged. The road crews unclog the culverts manually. Also, many times bent culverts are simply replaced, which requires digging up the road to remove and replace them.

Various means have been designed to alleviate some of the above-described problems but such means still suffer from certain disadvantages and shortcomings. For example, U.S. Pat. No. 6,000,152 discloses one attempt to achieve cleaning a culvert by providing a culvert cleaning apparatus of use with earth moving machinery having a bucket, which comprises a pivotal attachment assembly extending across a bucket and attached to the opposing side panels and a scoop for digging and removing material from a culvert. A limitation of this device, however, is that in order to position a scoop to be inserted in the opening of the culvert, it is necessary to use a hydraulically controlled bucket of the earth moving machinery that is lowering below the level of the roadway and into the culvert opening and to stop the road work during the culvert cleaning. Also, this device cannot operate independently from the routine road maintenance because the device shares both the bucket and the power for of the earth moving machinery. This device is also not particularly adapted to repair culvert that are bent inward.

Reference also U.S. Pat. No. 6,499,173 which discloses a culvert cleaning apparatus comprised of a culvert cleaning tool, operated by a motor, engaged to the longitudinal beam which is secured on the ground. Shortcomings of this construction include the fact that the apparatus must be secured on the ground during cleaning the culvert. The device is also large and cumbersome and would require an extensive set up time for each culvert to be opened.

For these and other reasons, the present invention is directed to overcoming one of more of the problems set forth above. In this respect, it is desirable to provide a culvert opening and clearing apparatus which is designed to be operably mounted to an implement of heavy machinery such as a grader.

It is further desirable to provide a culvert opening and clearing apparatus which is designed to be operated independently from the road maintenance.

It is further desirable to provide a culvert opening and clearing apparatus which is designed to utilize the auxiliary hydraulic connection provided by the implement of heavy machinery.

It is also desirable to provide a culvert opening and clearing apparatus which eliminates the labor intensive job and reduces the time to unclog the culvert, which allows the road crews to make unclogging the culverts part of their routine road maintenance.

It is further desirable to provide a culvert opening and clearing apparatus which allows the road crews to reduce the possibility of getting injured.

SUMMARY OF INVENTION

The present invention overcomes many of the shortcomings and limitations of the prior art devices discussed above and teaches a culvert opening and cleaning apparatus for use with heavy machinery, which comprises a mounting means operably engaged to an implement of heavy machinery, a telescoping arm member attached to the mounting means, the telescoping arm member having an outer housing and an inner concentric arm that are telescopically slidable relative to each other, a culvert cleaning tool engaged to the inner arm of the telescoping arm member, and a telescoping ram having at least one cylinder and a piston that are telescopically slidable relative to each other, wherein a distal end of the piston is attached to the culvert cleaning tool for positing the culvert cleaning tool to be inserted in an opening of the culvert.

In accordance with a second embodiment of the present invention, the telescoping ram is operable to be powered by an auxiliary hydraulic.

In accordance with a third embodiment of the present invention, the mounting means is a mounting bracket.

In accordance with a fourth embodiment of the present invention, the culvert cleaning tool is a tapered shoe.

In accordance with a fifth embodiment of the present invention, a culvert opening and cleaning apparatus for use with heavy machinery comprises a mounting means operably engaged to an implement of heavy machinery, a telescoping extension cylinder arm attached to the mounting means, the telescoping arm member having at least one interconnected extendable cylinder and an inner concentric arm that are telescopically slidable relative to each other, and a culvert cleaning tool engaged to the inner arm of the telescoping extension cylinder arm.

In accordance with a sixth embodiment of the present invention, the telescoping extension cylinder arm is operable to be powered by an auxiliary hydraulic.

These and other features and advantages will be in part apparent and in part pointed out hereinafter.

BRIEF DESCRIPTION OF DRAWINGS

These and other inventive features and advantages appear from the following Detailed Description when considered in connection with the accompanying drawings in which similar reference characters denote similar elements throughout the several views.

DETAILED DESCRIPTION

For illustration purposes only, the following various embodiments of the culvert opening and cleaning apparatus with a mounting bracket for operably mounting to the implement of heavy machinery and a telescoping extension cylinder arm operable to be powered by the auxiliary hydraulic. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1B:
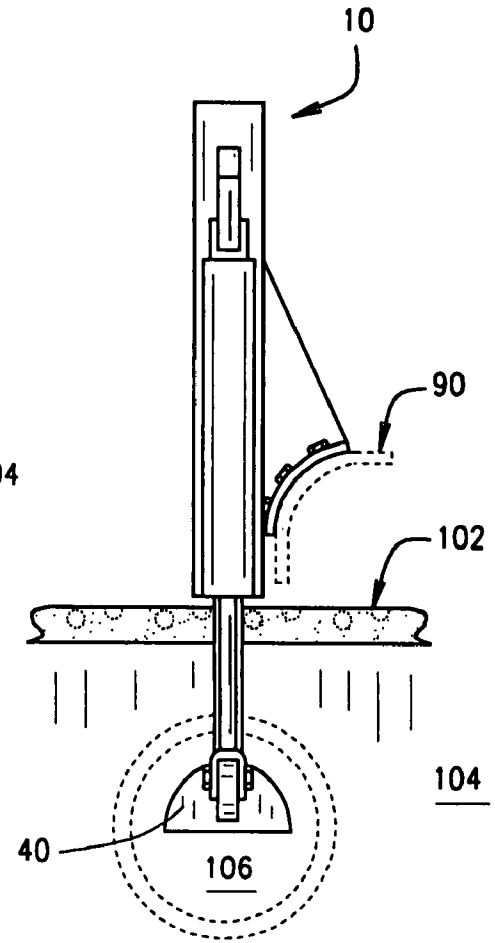
FIG. 1*b* is a side view of the invention attached to a grader which sits on a roadway over a culvert with one of the invention's embodiments.
Figure 1A:
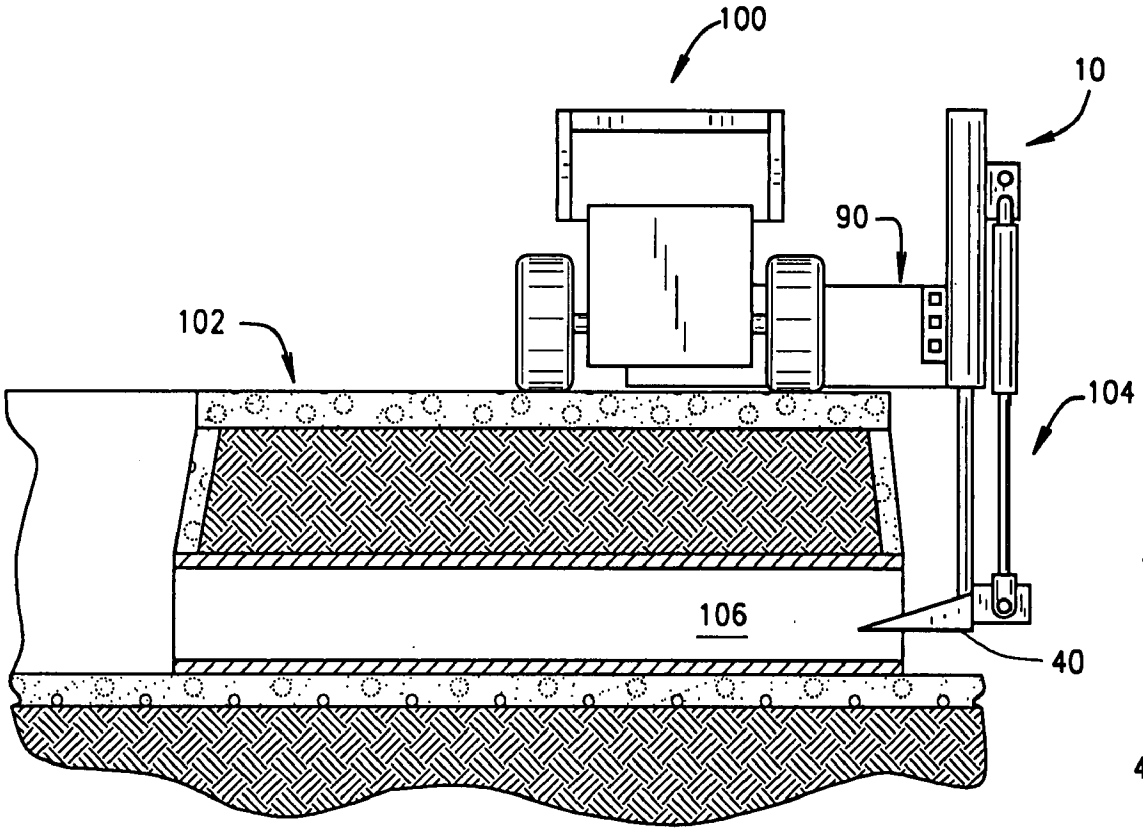
FIG. 1*a* is a rear view of the invention attached to a grader which sits on a roadway over a culvert with one of the invention's embodiment.

Referring to the drawings more particularly by reference numbers wherein like numerals refer to like parts, the numeral 10 in FIGS. 1*a* and 1*b* identify a culvert opening and cleaning apparatus constructed according to the teachings of the present invention.

Referring again to FIGS. 1*a* and 1*b,* the culvert opening and cleaning apparatus 10 is removably, operably mounted to an implement of heavy machinery, such as a blade 90 of a grader 100. A rear view of a grader 100 is shown with the blade 90 telescopically extended horizontally to the right of the road 102 above the drainage ditch 104. It is typical for a grader to have a blade that can telescopically move horizontally left and right laterally with respect to the direction of travel of the grader. The culvert cleaning apparatus 10 can then be extended to position the shoe 40 adjacent the culvert opening 106. The cleaning apparatus 10 can therefore be positioned horizontally with the use of the telescopic movement of a typical grader blade and can be positioned vertically by telescopically extending.

Figure 2:
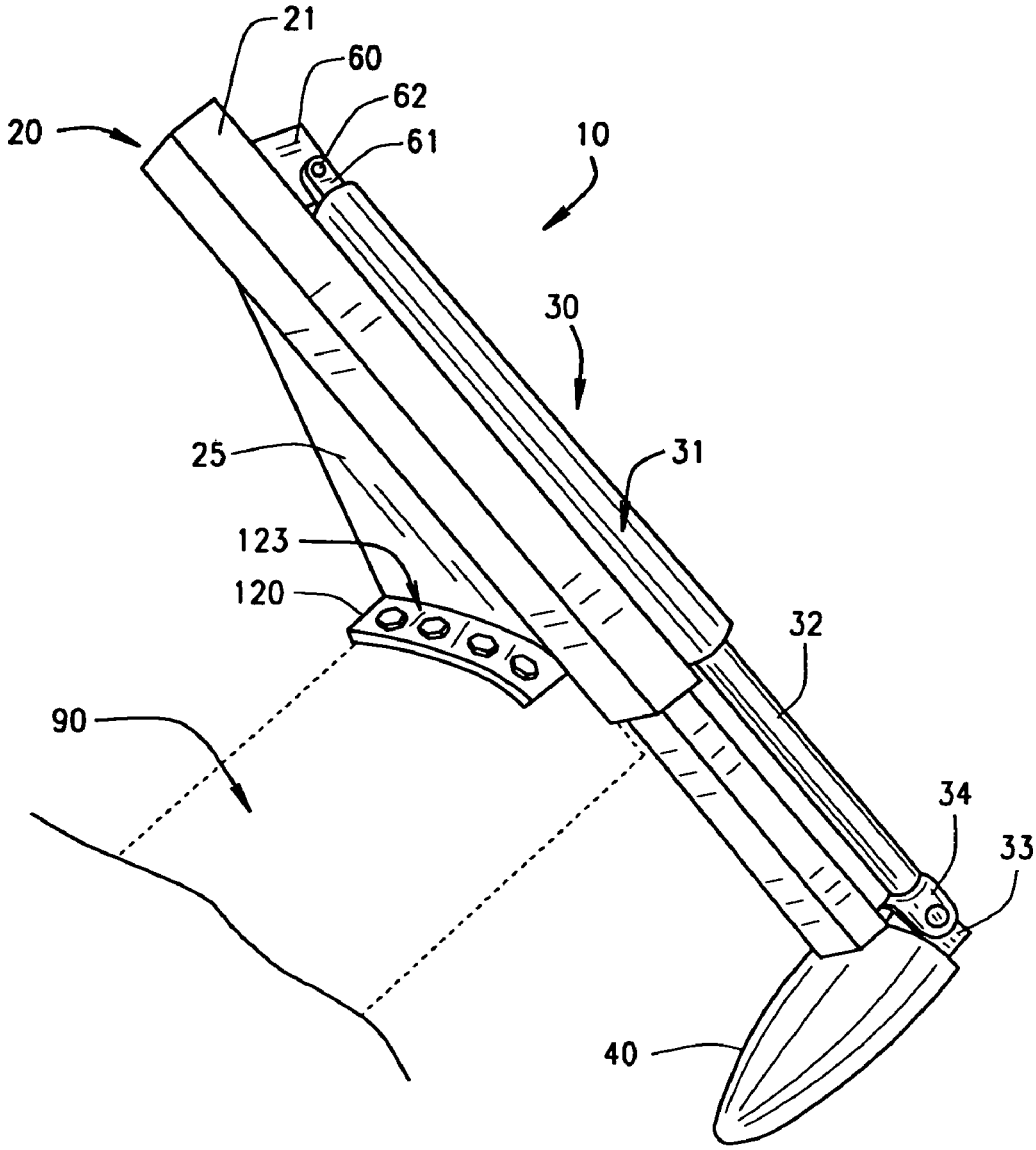
FIG. 2 is a perspective view of the culvert opening and cleaning apparatus in accordance with the teachings of the present invention.
Figure 3:
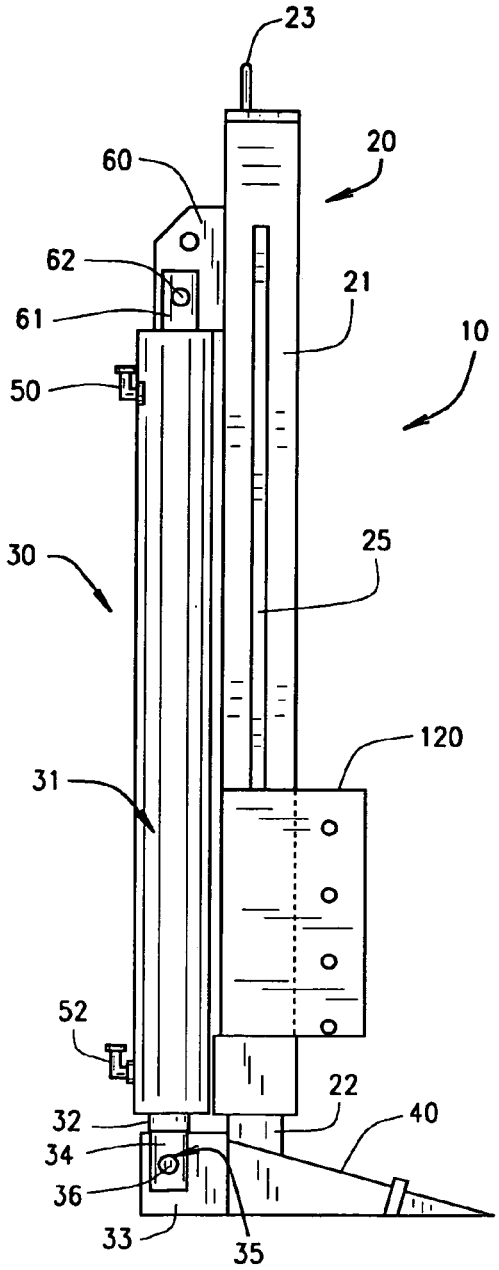
FIG. 3 is a front elevational view of the culvert opening and cleaning apparatus of FIG. 2.

Referring to the drawings in detail and more specifically FIG 2 and FIG 3, a culvert opening and cleaning apparatus 10 comprises a mounting bracket 120 operably engaged to the blade of the grader 90 in FIG 2 (not shown in FIG 3), a telescoping arm member 20 attached to the mounting bracket 120, a culvert cleaning tool 40 engaged to the inner arm 22 of the telescoping arm member 20, and a telescoping ram 30. The telescoping arm member 20 is attached to the implement of heavy machinery by the mounting bracket 120 which is removably mounted on a mounting plate of the blade of the grader (not shown in FIG 3). It is preferable that the mounting bracket 120 is attached to the blade of the grader (not shown in FIG 3) by bolts, which are screwed into the bolt holes 121. However, another attachment method well known in the art could be utilized.

Figure 4A:
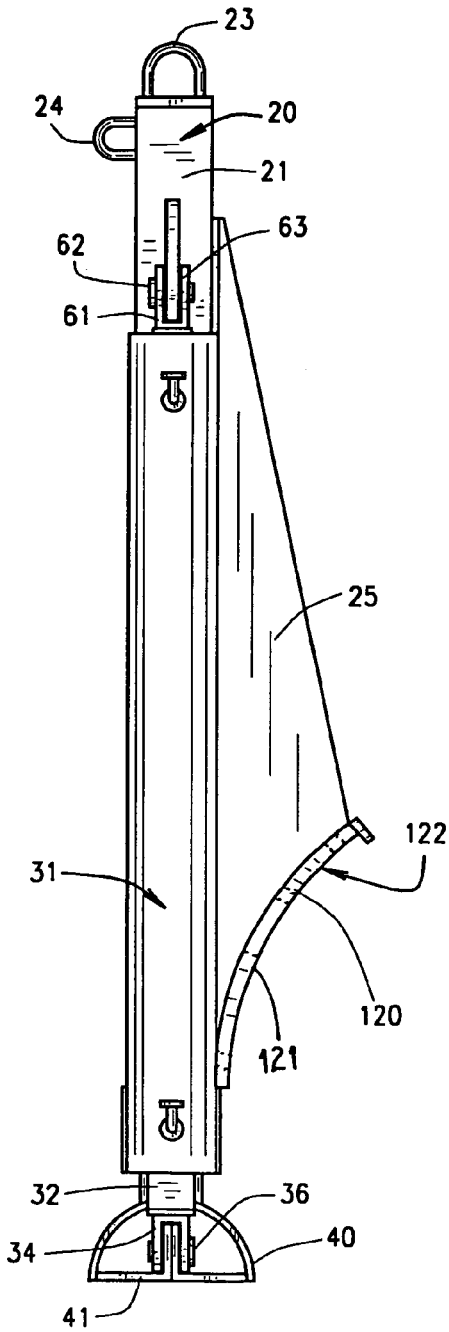
FIG. 4A is a left side elevational view of the culvert opening and cleaning apparatus of FIG. 2.
Figure 4B:
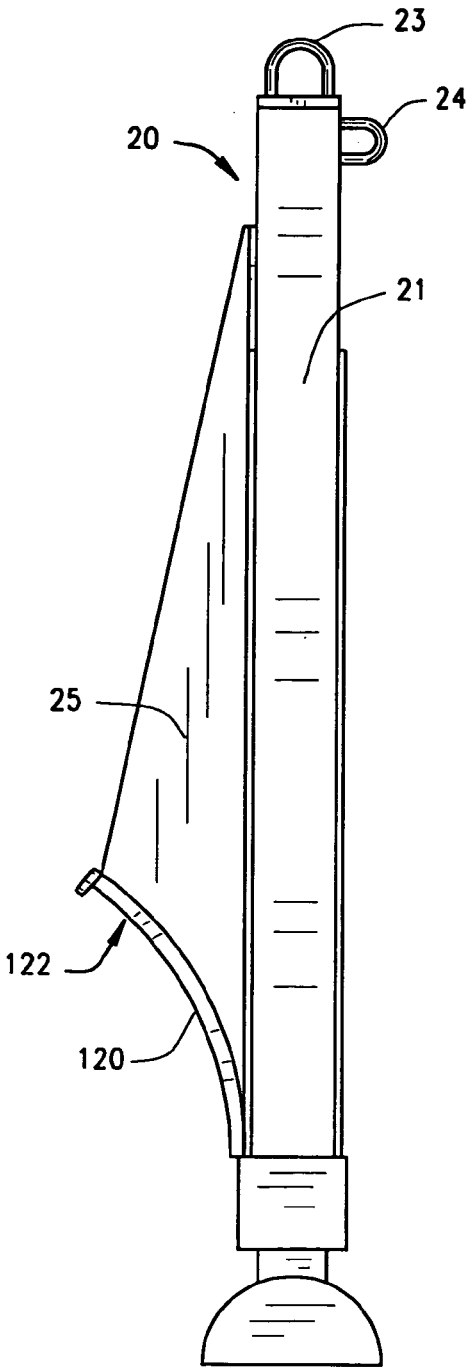
FIG. 4B is a right side elevational view of the culvert opening and cleaning apparatus of FIG. 2.
Figure 5:
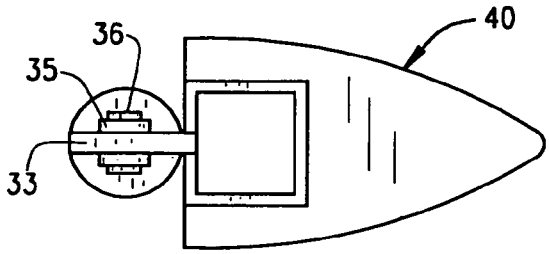
FIG. 5 is a top plan view of the culvert opening and cleaning apparatus of FIG. 2.

Referring to the FIG. 4*a,* FIG. 4*b* and FIG. 5, the mounting bracket 120 may have a curved or substantially "V" shaped interior surface 122 such that the blade of the grader will fit within the mounting bracket 120 in a stable manner. The mounting bracket 120 is securely connected to the telescoping arm member 20 by a flange 25. One side face of the flange 25 is attached on the exterior surface 123 of the mounting bracket 120 and the other side face of the flange 25 is securely connected to the telescoping arm member 20. The flange 25 can have different shapes. For example, the flange 25 in FIG. 4 can be generally triangular with a curved side face that shaped corresponding to the exterior surface 123 of the mounting bracket 120. The flange 25 extends from the exterior surface 123 of the mounting bracket 120 to the telescoping arm member 20. The one side face of the flange 25 extends along a longitudinal axis of the telescoping arm member 20. Although the flange 25 is preferably welded both to the telescoping arm member 20 and to the exterior surface 123 of the mounting bracket 120, other connecting means may be used.

Referring again to the FIG. 2 and FIG. 3, the telescoping arm member 20 is comprised of a housing 21 and an inner concentric arm 22. The inner arm 22 is reciprocally movably inserted into the housing 21 and is telescopically slidable in the interior wall of the housing 21. The telescoping arm member 20 may further have a clamp ring 23 for lifting the whole device 10. The clamp ring 23 is rigidly secured to the upper end face of the telescoping arm member 20. The rim of the clamp ring 23 may have a semicircle or arc shape. The telescoping arm member 20 may also have a hydraulic line holder 24 for holding the hydraulic power line (not shown). The hydraulic line holder 24 is rigidly secured to the upper end of the longitudinal surface of the telescoping arm member 20. The rim of the hydraulic line holder 24 may have a semicircle or arc shape.

The culvert-cleaning tool, such as a shoe 40 or a scoop, is connected to the lower end of the inner arm 22. The shoe can reciprocally move in the longitudinal direction by a piston 32 of the telescoping ram 30. The telescoping ram 30 is comprised of an outer cylinder 31, the piston 32, an upper coupling device 60, and a bottom coupling device 33. The piston 32 is reciprocally movably inserted into outer cylinder 31 and is telescopically slidable in the interior wall of the outer cylinder 31.

A preferred embodiment of the telescoping ram 30 is powered by the auxiliary hydraulic. The telescoping ram 30 is engaged to the shoe 40 by the bottom coupling device 33 to transfer the power for moving. A rivet pin 36 connects the middle of a U-shaped bracket 34 of the bottom coupling device 33 having two small pin apertures 35 and a coupling flange 41 of the shoe 40. The rivet pin 36 may be replaced with a Search Term Begin bolt Search Term End or other suitable means. The telescoping ram 30 is engaged to the telescoping arm member 20 by the upper coupling device 60. The upper coupling device 60 is secured to the upper end face of the telescoping ram 30. A rivet pin 62 connects a U-shaped bracket 61 of the upper coupling device 60 having two small pin holes 63.

A preferred embodiment of the invention mounts to the blade implement of a grader, which is a heavy piece of machinery utilized to grade gravel roads. The typical grader has a curved blade or plow implement. The implement can be raised and lowered to disengage and engage the underlying surface such as a gravel road. The implement can also typically telescope laterally to extend on either side of the path of travel of the machine. The present invention can be mounted on one side of the implement thereby utilizing the telescoping action of the implement to position itself laterally above the clogged opening of the culvert. The typical blade implement can also adjust its pitch to thereby rotate the invention forward and backward. The invention further has a telescoping arm for lowering the shoe attached thereto. A telescoping ram 30 can be powered by the auxiliary hydraulics of the heavy machinery to implement the telescoping action. The telescoping ram has an upper hydraulic connection 50 and lower hydraulic connection 52. The shoe is then maneuvered into the hole to unclog the hole and also to bend the opening back to its original shape. In an alternative embodiment the invention could also include a laterally extending telescoping arm, which would be useful on heavy implements of machinery that do not have a laterally extending telescoping implement.

In the drawings and specification, there have been disclosed typically preferred embodiments of the invention, and, although specific terms are employed, they are used in a generic and descriptive sense only and not for purpose of limitation. Many changes, modifications, variations and other uses and applications of the culvert opening and cleaning apparatus will become apparent to those skilled in the art after considering this specification and the accompanying drawings. All such changes, modifications, variations and other uses and applications which do not depart from the spirit and scope of the invention are deemed to be covered by the invention which is limited only by the claims which follow.

The invention claimed is:

1. A culvert opening and cleaning apparatus for use with heavy machinery, comprising:

a telescoping arm member adapted to be mounted to an implement of a heavy machinery such that the telescoping arm is oriented vertically and where the telescoping arm member having an outer housing and an inner concentric arm that are telescopically slidable relative to each other;

a culvert cleaning tool substantially orthogonally mounted to the inner arm of the telescoping arm member and said culvert cleaning tool having a convex upward facing surface; and a telescoping ram having at least one concentric cylinder and a piston that are telescopically slidable relative to each other and mounted in a substantially parallel side-by-side relationship relative to the telescoping arm, wherein a distal end of the piston is attached to the culvert cleaning tool for positing the culvert cleaning tool to be inserted in an opening of a culvert.

2. The culvert opening and cleaning apparatus for use with heavy machinery of claim 1, wherein the telescoping ram is operable to be powered by an auxiliary hydraulic of the heavy machinery.

3. The culvert opening and cleaning apparatus for use with heavy machinery of claim 2, wherein the culvert cleaning tool is a tapered shoe.

4. The culvert opening and cleaning apparatus of claim 1, where the telescoping arm member is adapted to be mounted to the implement with a mounting bracket attached to said telescoping arm and where said mounting bracket is adapted to be mounted to a grader blade implement.

5. A culvert opening and cleaning apparatus for use with heavy machinery, comprising:

a telescoping arm member adapted to be mounted to an implement of a heavy machinery such that the telescoping arm is oriented vertically and where the telescoping arm member comprises at least one interconnected outer housing cylinder and an inner concentric arm such that the outer housing and inner arm are telescopically slidable relative to each other; and a culvert cleaning tool substantially orthogonally mounted to a distal end of the inner arm of the telescoping arm member and said culvert cleaning tool having a convex upward facing surface.

6. The culvert opening and cleaning apparatus for use with heavy machinery of claim 5, wherein the telescoping extension cylinder arm is operable to be powered by an auxiliary hydraulic of the heavy machinery.

7. The culvert opening and cleaning apparatus for use with heavy machinery of claim 6, wherein the telescoping arm member is adapted to be mounted to the implement with a mounting bracket attached to said telescoping arm and where said mounting bracket is adapted with a curved mounting surface to be mounted to a grader blade implement.

8. The culvert opening and cleaning apparatus for use with heavy machinery of claim 1, wherein the culvert cleaning tool is a tapered shoe.

* * * * *